US011052984B1

(12) United States Patent
Boettcher

(10) Patent No.: US 11,052,984 B1
(45) Date of Patent: Jul. 6, 2021

(54) MARINE VEHICLE CLIMATE CONTROL SYSTEM, APPARATUS AND METHOD

(71) Applicant: SUMMIT MARINE TECHNOLOGIES, INC., South Abington Township, PA (US)

(72) Inventor: Mark A. Boettcher, South Abington Township, PA (US)

(73) Assignee: SUMMIT MARINE TECHNOLOGIES, INC., South Abington, PA (US)

( * ) Notice: Subject to any disclaimer, the term of this patent is extended or adjusted under 35 U.S.C. 154(b) by 0 days.

(21) Appl. No.: 17/182,578

(22) Filed: Feb. 23, 2021

(51) Int. Cl.

| | |
|---|---|
| ***B63J 2/12*** | (2006.01) |
| ***F24F 11/83*** | (2018.01) |
| *F24F 130/00* | (2018.01) |
| *F24F 11/30* | (2018.01) |

(52) U.S. Cl.
CPC ..... *B63J 2/12* (2013.01); *F24F 11/83* (2018.01); *F24F 11/30* (2018.01); *F24F 2130/00* (2018.01)

(58) Field of Classification Search
CPC ..... B63J 2/12; B63J 2/00; B63J 2/04; B63J 2/06; B63J 2/08; B63J 2002/005; F24F 11/83
See application file for complete search history.

(56) References Cited

U.S. PATENT DOCUMENTS

| | | | | |
|---|---|---|---|---|
| 3,901,177 | A | 8/1975 | Scott | |
| 8,406,162 | B2 | 3/2013 | Haupt et al. | |
| 10,179,633 | B2 | 1/2019 | Carnevali | |
| 2001/0001363 | A1* | 5/2001 | Dodge | B63J 2/04 62/240 |
| 2002/0017108 | A1* | 2/2002 | Schooley | B63J 2/04 62/240 |
| 2004/0007005 | A1* | 1/2004 | Brunner | B63J 3/02 62/240 |
| 2016/0169561 | A1* | 6/2016 | Giampiccolo | B63J 2/04 62/428 |
| 2017/0211837 | A1* | 7/2017 | Gupta | G05B 13/04 |

FOREIGN PATENT DOCUMENTS

JP 2005295160 A * 10/2005

* cited by examiner

*Primary Examiner* — Edward F Landrum
*Assistant Examiner* — Alexis K Cox
(74) *Attorney, Agent, or Firm* — Weitzman Law Offices, LLC

(57) ABSTRACT

A control apparatus for a climate control system of a boat involves at least one processor, non-transitory storage accessible by the processor, and programming which, when executed by the at least one processor will cause the at least one processor to, when a water-fed climate control unit of the boat is operating A) determine a then-current depth at a current location of the boat, B) compare the then-current depth at the current location of the boat relative to a specified minimum acceptable depth, and C) when the then-current depth at the current location of the boat is less than the specified minimum acceptable depth, cause the CCU and water pump to shut off. A corresponding method is also described.

30 Claims, 8 Drawing Sheets

MARINE VEHICLE CLIMATE CONTROL SYSTEM, APPARATUS AND METHOD

FIELD OF THE INVENTION

This disclosure relates generally to boats and, more particularly, to climate control systems of boats.

BACKGROUND

Nowadays recreational boats that have interior cabins or berths and are classified by the U.S. Coast Guard as Class 2 and up, particularly those having a length of 10 meters or more, are commonly equipped with a climate control (CC) system (i.e., air conditioning, heating or both). Such systems work similar to land based systems except, instead of using air on the a condenser side of the unit, they circulate water through the condenser's coil. More particularly, water is drawn into the system using a pump mounted below the waterline, via an inlet located on the hull, typically as low as practical. The pump causes the water to flow into the condenser coil of the climate control unit and then out through an outlet located above the waterline.

The use of water from under the boat is advantageous because, being denser than air, it is a more efficient heat transfer medium. However, the use of water does present some problems in that, the pumped water is not clean—it may include "debris" (e.g., sand, dirt, algae, silt, underwater vegetation, small branches, and even small aquatic animals). While, the inlet can be equipped with a strainer, screen and/or other filtration mechanism (individually and collectively referred to herein as a "strainer" for simplicity), to prevent larger debris from entry, they must still have openings that will allow a sufficient volume of water to enter for the system to operate, and thus will always allow some level of potentially clogging debris in. While some amount of such debris is not a problem if it passes through the system and back out the outlet. However, some will inevitable become lodged within the system and, in most cases, will build up over time ("foul") until cleaned, thereby at best, reducing the efficiency of the climate control system over time and, at worst, clogging the system to the point where extensive cleaning is required and/or costly damage is done.

In addition, in general, the closer the bottom of the hull is to the bed of the body of water it is in, the more likely that debris that can foul the inlet will enter the system or clog the strainer or piping.

The operation of the tides in tidal waters compounds this problem because, as the tides change between their daily highs and lows (which vary over time due to the position of the earth and moon), the hull of a stationary boat in still water will nevertheless approach and move away from the bed over which it is positioned. Moreover, the changing of the tides varies with location, so the time and height of low tide may can be different at two locations a few miles apart, or in different types of waterways (e.g., canal, inlet, bay, etc.).

Plainly, in most cases, the closer the climate control system inlet gets to the bed, the more debris the pump will likely draw into the inlet. Accordingly, the greatest likelihood that such fouling will occur is around low tide when the hull is closest to the bed.

Large bodies of non-tidal waters (e.g., the Great Lakes) can have similar phenomenon of less predictable periodic rise and fall, called seiches, typically caused by wind and changes in atmospheric pressure, that will extend over a period of hours in a manner similar to tides. In other cases, the levels of non-tidal waters can rise and fall over time due to, for example, the wind and or barometric effects that cause seiches in larger bodies of water as well as, precipitation or drainage due, for example, to the opening/closing of dams or spillways. As such, boats in these waters can face a similar problem when the water is at or near a low point or the water level falls to a point where debris in the water could cause fouling.

Still further, once sufficient fouling has occurred, the cost to clear it can be expensive and, even worse, if such fouling causes damage or a failure of some component of the climate control system, the costs can be even higher both in monetary costs and lost availability.

Of course, one could avoid the fouling problem entirely by not using the climate control system at all, but that is not an acceptable approach for most cases.

One can also regularly clean the piping of built up debris, but that is a remedial effort and requires scheduling, loss of use of the boat for a time, and the costs associated with use of a dry dock or the hiring of a skilled diver to undertake that work.

Thus, currently, apart from the use of strainers, acceptable preventative solutions that reduce the problem of fouling remain elusive.

SUMMARY

I have devised a solution that provides a significant advance in addressing the aforementioned fouling problem.

One aspect of this disclosure involves a control apparatus for a Climate Control (CC) system of a boat, wherein the CC system includes a water-fed Climate Control Unit (CCU) and a water pump which feeds water to the CCU. The control apparatus includes at least one processor, non-transitory storage accessible by the processor, and programming which, when executed by the at least one processor will cause the at least one processor to, when the water-fed CCU is operating: A) determine a then-current depth at a current location of the boat, B) compare the then-current depth at the current location of the boat relative to a specified minimum acceptable depth, and C) when the then-current depth at the current location of the boat is less than the specified minimum acceptable depth, cause the CCU and water pump to shut off.

Another aspect of this disclosure involves a control apparatus for a Climate Control (CC) system of a boat having a hull. The control system includes a Climate Control Unit (CCU) having a condenser including an inlet and outlet, a water pump having an inlet and an outlet, wherein the outlet of the water pump is coupled to the inlet of the condenser, a water inlet, located on the hull below a waterline and coupled to an inlet side of the water pump, a water outlet located on the hull above the waterline and coupled to the outlet of the condenser unit, a GPS receiver, an Internet Interface Unit (IIU), and a controller, coupled to the air conditioning unit, GPS receiver and IIU. The controller includes at least one processor and non-transitory storage accessible by the processor. During operation of the CCU, water will flow into the water inlet, through the water pump, through the condenser and out the water outlet. The at least one processor of the controller, operating under program control when the CCU is operating, will A) obtain a set of current GPS coordinates for the boat location via the GPS receiver, B) using the set of GPS coordinates, obtain tide depth predictions for the location via the IIU, and C) based upon a current time of day, determine a current depth at the location. In accordance with a pre-specified depth threshold, the controller will cause the CCU and water pump to shut off.

Yet another aspect of this disclosure involves a control apparatus for a Climate Control (CC) system of a boat having a hull. The CC system includes a Climate Control Unit (CCU) having a condenser including an inlet and outlet, a water pump having an inlet and an outlet, wherein the outlet of the water pump is coupled to the inlet of the condenser unit, a water inlet, located on the hull below a waterline and coupled to an inlet side of the water pump, a water outlet located on the hull above the waterline and coupled to the outlet of the condenser unit, a depth finder, and a controller, coupled to the air conditioning unit. The controller includes at least one processor, and non-transitory storage accessible by the processor. During operation of the CCU, water will flow into the water inlet, through the water pump, through the condenser unit and out the water outlet. When the CCU is operating, the controller will obtain depth readings from the depth finder and, when a then-current depth reading is less than a pre-specified minimum depth threshold, the controller will cause the CCU and water pump to shut off.

Another aspect of this disclosure involves a method performed by a controller to control a Climate Control (CC) system of a boat, when the CC system includes a water-fed Climate Control Unit (CCU) and a water pump which feeds water to the CCU. The method involves when the water-fed CCU and water pump are operating, i) determining a then-current depth at a current location of the boat, ii) comparing the then-current depth at the current location of the boat to a pre-specified minimum acceptable depth, and iii) when the then-current depth at the current location of the boat is less than the pre-specified minimum acceptable depth, causing the water-fed CCU and water pump to shut off.

BRIEF DESCRIPTION OF THE DRAWINGS

This disclosure is further described in the detailed description that follows, with reference to the drawings, wherein the same reference numbers appearing in the various drawings and description designate corresponding or like elements among the different views. and in which.

DETAILED DESCRIPTION

As noted above, I have devised a solution that provides a significant advance in addressing the aforementioned fouling problem caused by debris (as defined above). In simplified overview, I have devised systems, different apparatus and methods that can be deployed on a boat, either when built or retrofitted, that significantly reduces the possibility of fouling of the climate control system of a boat where the changing of tides or seiches could cause the bottom of the boat to be too close to the bed of the body of water. Moreover, advantageously, implementations employing the teachings herein can help prevent fouling that could be caused by drawing in aquatic vegetation growing in, and extending up from, the bed beneath the boat.

Figure 1:
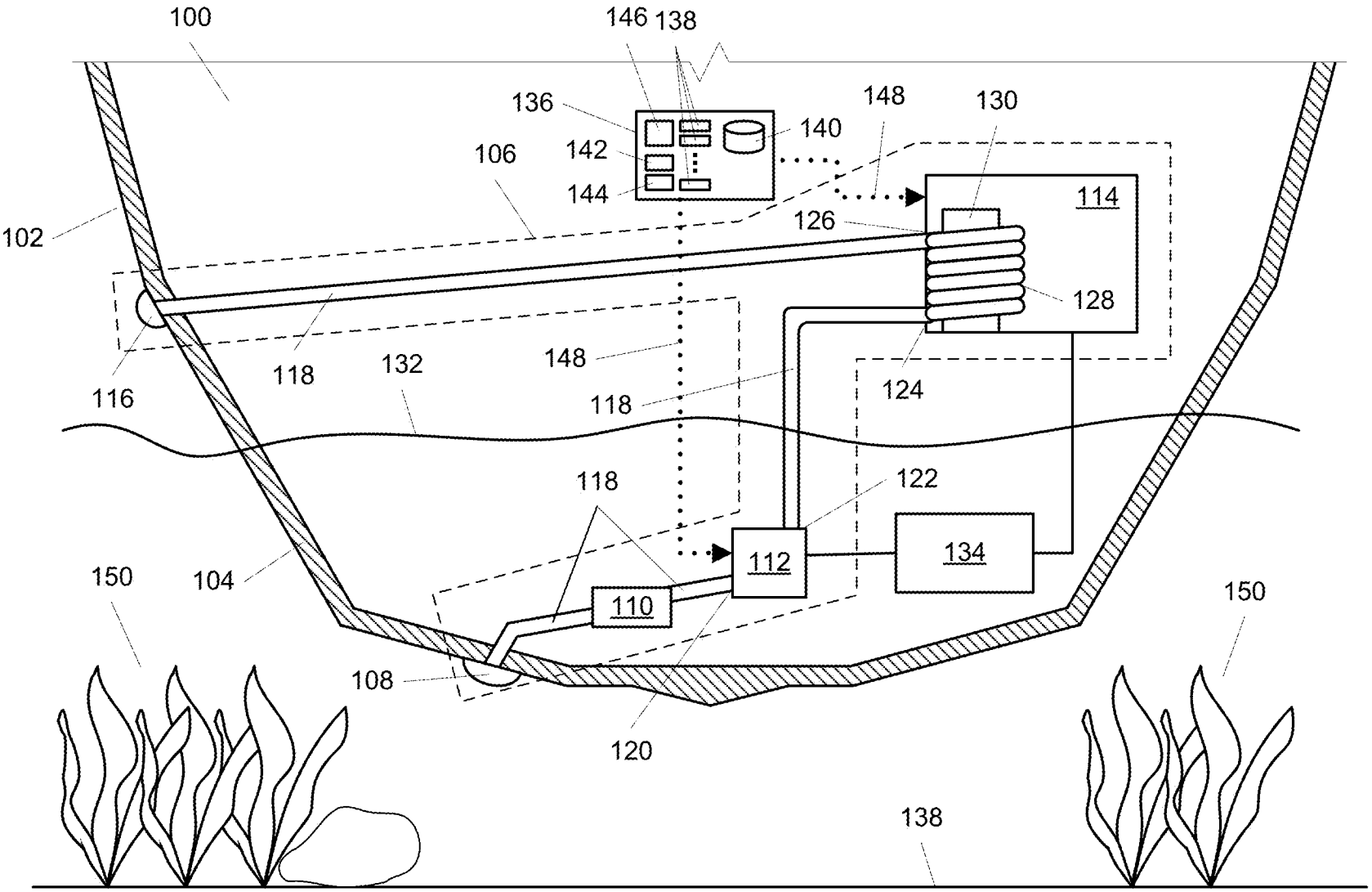
FIG. 1 illustrates, in simplified overview form, a cutaway view of a system according to the teachings herein, in boat having, inter alia, a hull and a climate control ("CC") system.

FIG. 1 illustrates, in simplified overview form, a cutaway view of a system 100 according to the teachings herein, in boat 102 having, inter alia, a hull 104 and a climate control ("CC") system 106.

The climate control ("CC") system 106 is used, depending upon the particular CC system 104, to cool (i.e., as an air conditioner) and/or to heat (i.e., as a heat pump) the passenger compartment(s) (not shown) of the boat 102. The CC system 106 (within the dashed lines) is made up of a water inlet 108, a strainer 110, a water pump 112, a climate control unit (CCU) 114 and water outlet 116. Pipes 118 connect these various components together such that water will be drawn in to the CC system 106 via the water inlet 108, and pass through the strainer 110 under suction from the inlet 120 side of the water pump 112. The water is then pumped out the outlet 122 side of the water pump 112 to the CCU 114. More particularly, the water flows from the inlet 124 to the outlet 126 of a condenser coil 128 of the CCU 114. The condenser coil 128 of the CCU operates in conjunction with an evaporator 130 of the CCU 114 to remove heat from, or provide heat to, passenger cabin(s) (not shown) of the boat 102.

As is well known, the water inlet 108, strainer 110 and water pump 112 are located below the water line 132, whereas, the CCU 114 is typically, located, in whole or part, above the water line 132. Of course, the outlet 116 is always located above the water line 132.

The CCU 114 and water pump 112 are powered from a power source 134, which is typically shore power, an on-board generator or a battery bank (which may supply power, if DC power, directly or indirectly, if AC power, via a power inverter).

Finally, a controller 136, made up of one or more processors 138, non-transitory storage 140, RAM 142, programmed ROM 144, and input/output ("I/O") 146. The controller 136 is coupled 148, directly or indirectly to the CCU 114 and water pump 112 to effect their shut down (and re-start) under certain conditions. More particularly, in overview, in accordance with the teachings herein and as is explained in more detail below with reference to various example implementations, the controller 136 is used to, directly or indirectly cause the CCU 114 and water pump 112 to shut off in the event that the depth underneath the boat 102 (i.e., distance between the water inlet 108 and the underwater bed 138 beneath the boat 102) or between the boat 102 and potentially fouling-inducing underwater debris 150 (e.g., underwater vegetation, silt, submerged tree branches, etc.) is less than some pre-specified amount, as measured directly, estimated based upon tide predictions, or determined based upon some combination of the two. In addition, advantageously, by employing the teachings herein, other potential irregular circumstances where a change in distance between the boat 102 and underwater bed 138 that could cause fouling could happen, for example, during storm surges or periods involving multiple unusually large wave height events recurring within some specified period of time.

With the foregoing overview configuration in mind, various specific example implementation configurations will now be described for implementations intended exclusively for tidal waters, followed by implementations for non-tidal waters that can also be used in tidal waters.

Figure 2:
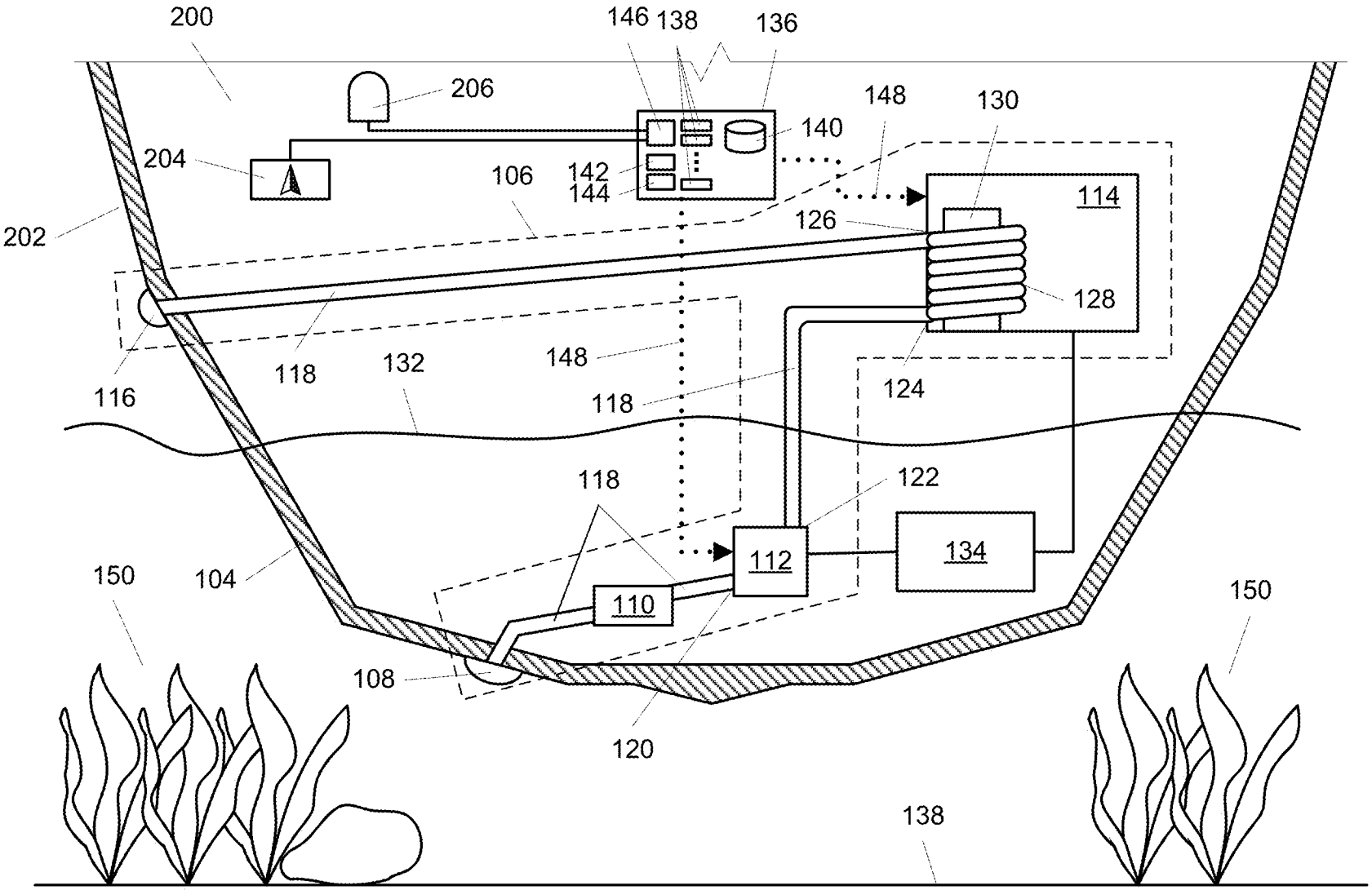
FIG. 2 illustrates, in simplified overview form, a system that is similar to the system of FIG. 1, and configured in a boat according to one example implementation variant of the teachings herein.

FIG. 2 illustrates, in simplified overview form, a system 200 that is similar to the system of FIG. 1, and configured in a boat 202 according to one example implementation variant of the teachings herein.

As shown in FIG. 2, in addition to the components of FIG. 1 (which, for brevity, will not be re-described), this boat 202 also includes a global positioning system ("GPS") receiver 204 and in Internet Interface Unit ("IIU") 206 coupled to the I/O 146 of the controller 136.

The IIU 206 allows for information to be retrieved from an internet-accessible website and made available to the processor(s) 138. Depending upon the particular implementation variant, the IIU 206 can include, for example, a cellular telephone hotspot, a device that can connect to the internet via WiFi of a marina or nearby provider, a WiFi extender, or via WiFi or satellite using some other internet access device, by way of non-limiting example for purposes of understanding only, a BGAN (Broadband Global Area Network) device, an Iridum Certus® device, a Globalstar GSP satphone/hotspot, a Skyroam Solis device, a Verizon Jetpack® MiFi device, a Glomex® WeBBoat device, a Shakespeare WebWatch device, a Winegard ConnecT device, or a Wave WiFi device.

The GPS receiver 204 is used by the controller 136 to identify the location of the boat, typically by longitude and latitude coordinates.

The IIU 206 allows the controller 136 to obtain information, via the internet, based upon the location coordinates obtained from the GPS receiver 204. More particularly, the controller 136 obtains tide prediction data for the location (or closest tide station location) for example, directly from the National Oceanic and Atmospheric Administration ("NOAA")(tidesandcurrents.noaa.gov or PORTS® data or nowCOAST), or, indirectly, from some other reputable provider of such information.

The controller 136 is programmed to use the tide prediction information for the location and then-current time to determine (i.e., estimate) the then-current depth at the then-current location. In addition, the controller 136 is programmed to cause the CCU 114 and water pump 112 to shut off under specific circumstances of minimum acceptable depth. Depending upon the particular implementation, such circumstances could include one or more of: when the then-current depth (as determined using the tide prediction information) is less than a certain depth (i.e., less than a threshold), for a certain time prior to and after the indicated low tide (i.e., an hour before and after low tide), for a time period beginning when the predicted falling tide level will cross to below a specified depth threshold and ending when the predicted rising tide level will cross to be back above the specified depth threshold. Of course, particular implementation variants could readily be created that allow for the user to independently change the time period before and after low tide, such that the two need not be of the same duration. likewise, variants could allow the user to change the depth threshold to account for, for example, hyper local circumstances, for example, the boat 202 being specifically located over a sand bar or close to or above a dense patch of underwater vegetation 150.

With this configuration, one example of the operation would be as follows. When the CC system 106 of the boat 202 is turned on, the controller 136 obtains GPS coordinates for the boat 202 from the GPS receiver 204. The controller 136 then, via the IIU 206, accesses a site to obtain tide prediction data for that location. Based upon that tide prediction data, the current time and the predicted low tide depth, the controller 136 will determine when the expected water depth at the boat's current location will cross over some specified threshold (i.e., will be deemed "too low"). Based upon that determination, the controller 136 will cause the CCU 114 and water pump 112 to shut off when that threshold is passed.

Figure 3:
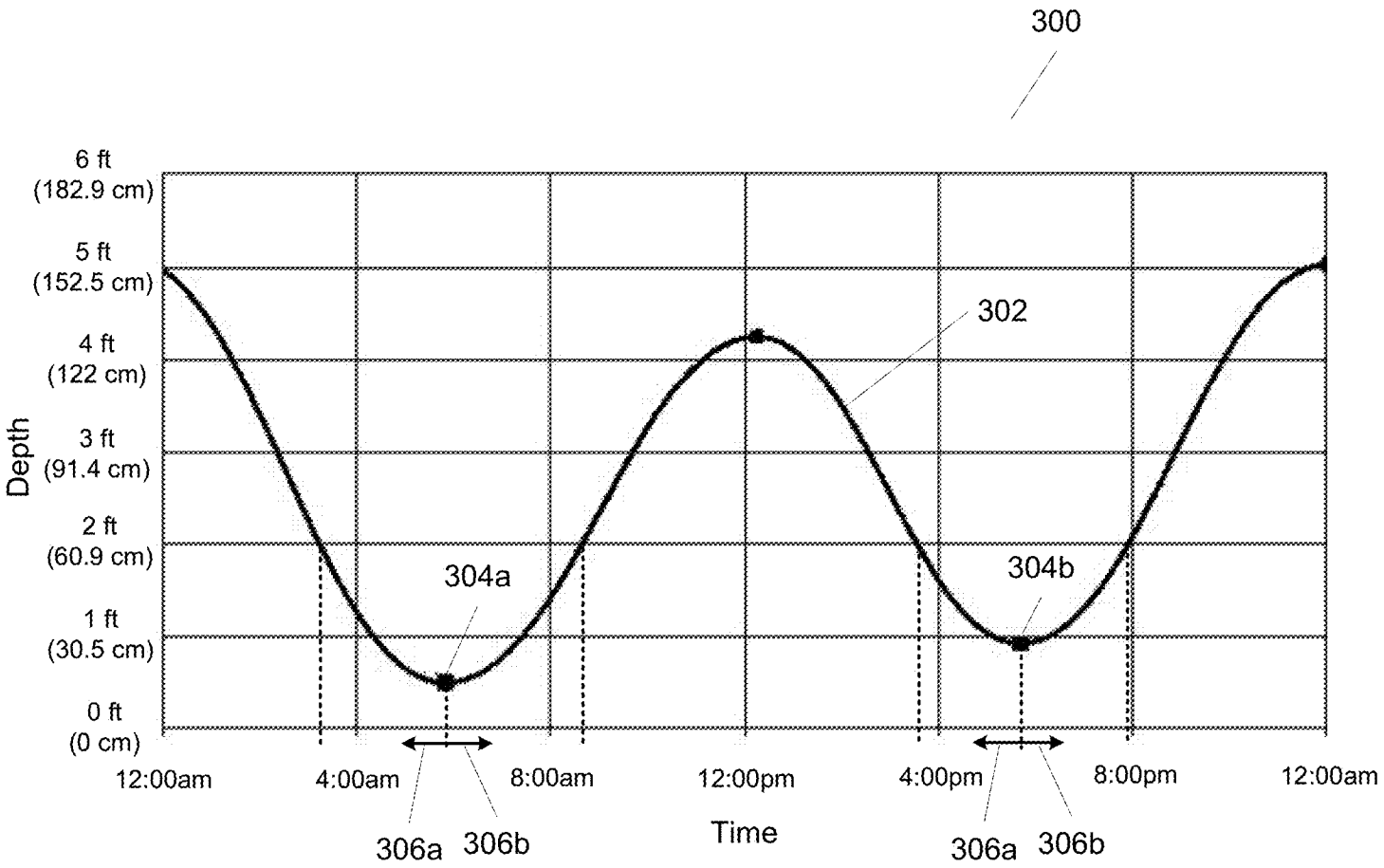
FIG. 3 is an example of a graph of tide prediction information for an example day at a particular location.

Turning now to FIG. 3, which is an example of a graph 300 of tide prediction information 302 for an example day at a particular location. As shown in FIG. 3, the depth varies cyclically over time within the 24 hour period, from a low of about 0.5 ft (15.3 cm) to a high of about 5 ft (152.5 cm). It should be noted that the metric values are approximate for simplicity.

With continuing reference to both FIG. 2 and FIG. 3, presume that for a given location (based upon GPS coordinates) the controller 136 obtains the tide prediction data 302, the as described above, for example, as represented in FIG. 3 or the graph itself. From that information 302, the controller 136 can determine when the depth will be so low that the CC system CCU 114 and water pump 112 should be shut off. More particularly, for some implementations, this is accomplished by identifying the times of low tide 304*a*, 304*b* and based upon some pre-set parameter, specifying, indirectly, a minimum acceptable depth based upon a shut off time that is some pre-specified amount of time 306*a* prior to the time of low tide 304*a* and a pre-specified time to turn the CCU 114 and water pump 112 back on that is some amount of time 306*b* after low tide, for example, 45 minutes before and after low tide. Alternatively, for other implementations, the foregoing is accomplished by the controller having a pre-set parameter directly specifying a particular minimum acceptable depth and, based upon the tide prediction data 302, causing the CCU 114 and water pump 112 to be shut off at the time when that threshold depth is predicted to occur and to turn back on at the time when that threshold depth is expected to be exceeded again. For example, as shown in FIG. 3, if the minimum acceptable depth is specified at 2 ft. (60.9 cm), then, based on the tide prediction data 302, that will first occur in the morning on that day at approximately 3:45 am and the CCU 114 and water pump 112 will be caused to shut off at that time. The tide prediction data 302 also indicates that the depth will exceed 2 ft (60.9 cm) at about 8:15 am, so the CCU 114 and water pump 112 will be caused to turn back on at about that time. Later that day, the same thing will occur at approximately, 3:50 pm and 7:55 pm, and so the CCU 114 and water pump 112 will be caused to correspondingly turn off and on at those times.

Depending upon the particular implementation, the specific parameters, i.e., time duration before low tide, time duration after low tide, and/or minimum acceptable depth, can be selectable from among a number of pre-programmed values stored in the storage 140 or ROM 144, they can be specifically entered for the particular boat 202, and, in some cases, can be varied "on the fly" if the boat 202 is unusually heavy or light for some reason.

Figure 4:
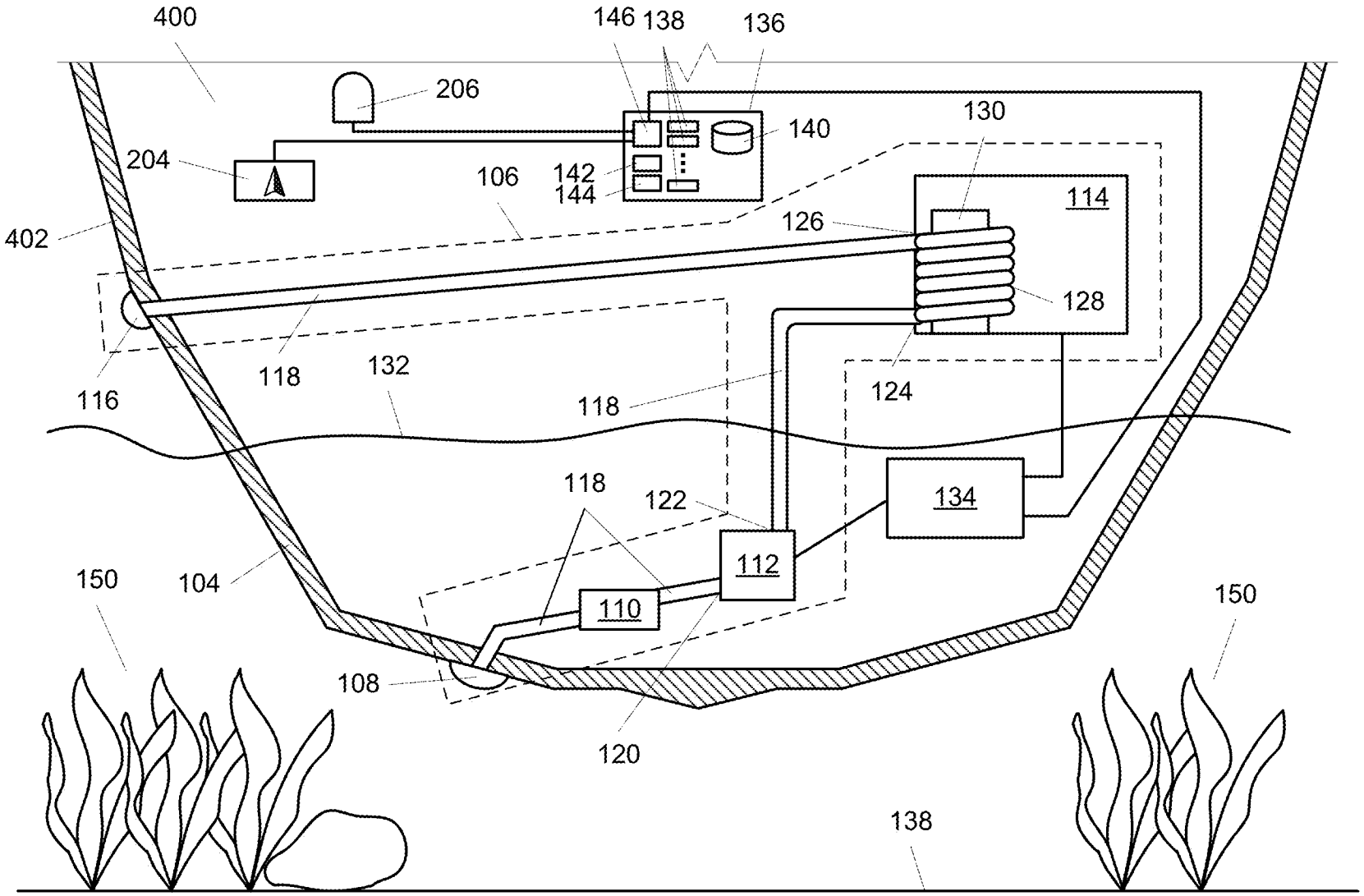
FIG. 4 illustrates, in simplified overview form, yet another system in a boat, according to an alternative variant to the variant of FIG. 2.

FIG. 4 illustrates, in simplified overview form, yet another system 400 in a boat 402, according to an alternative variant to the variant of FIG. 2. However, unlike in FIG. 2, with this variant, the controller 136 is coupled to the power source 134, rather than to the CCU 114 and water pump 112. As a result, when the CCU 114 and water pump 112 are to be shut off or turned back on, this is accomplished by the processor(s) 138 sending a signal to the power source 134 to cause the power source to disrupt/interrupt (i.e., cut off) power to those devices 112, 114, and, when the power to those devices 112, 114 is to be turned. back on, the processor(s) 138 will send an appropriate signal to the power source 134.

Figure 5:
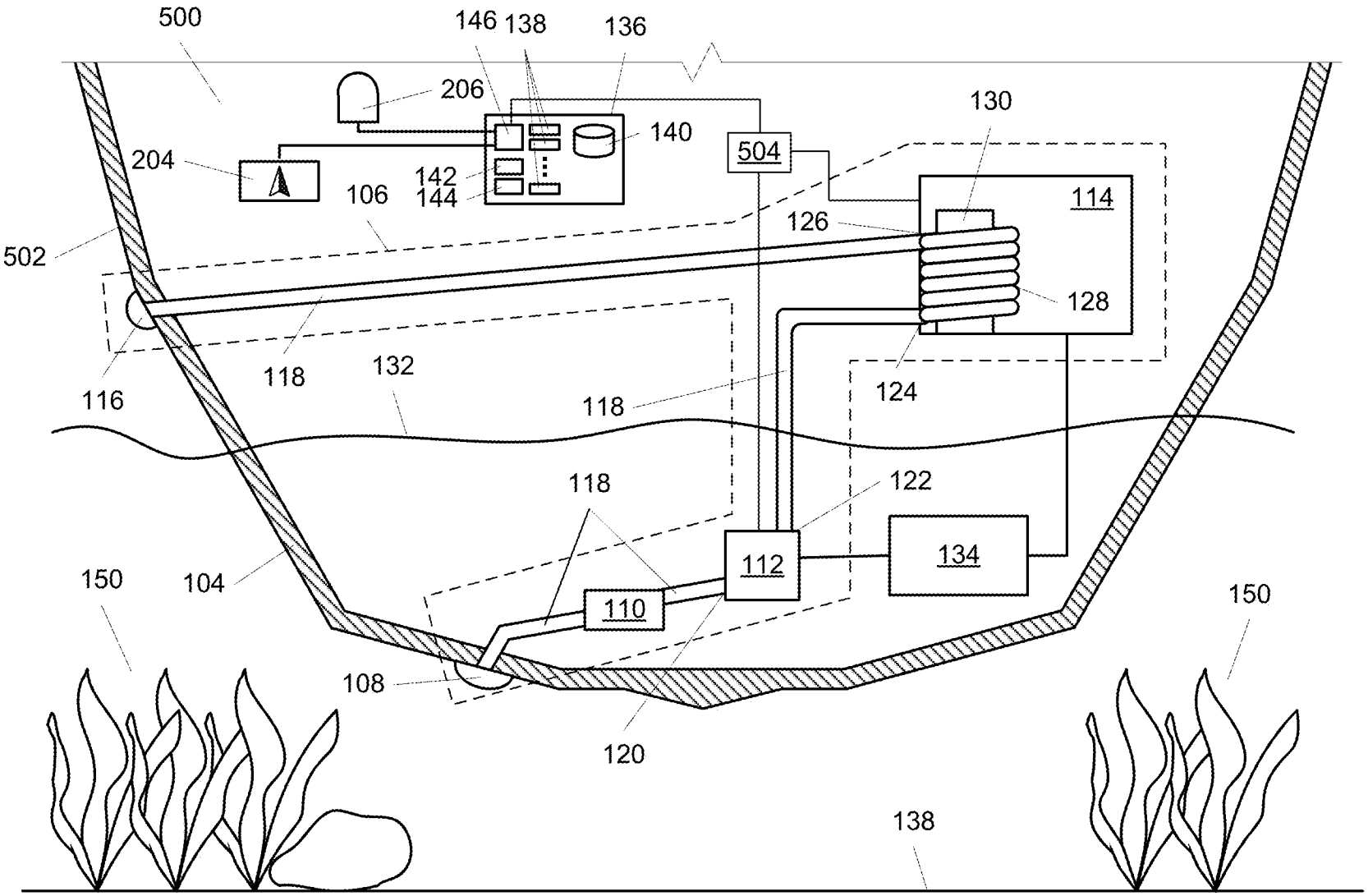
FIG. 5 illustrates, in simplified overview form, yet another variant system in a boat, that provides yet another example implementation variant of the teachings herein.

FIG. 5 illustrates, in simplified overview form, yet another variant system 500 in a boat 502, that provides yet another example implementation variant of the teachings herein. In this regard, FIG. 5 is similar in all respects to FIG. 2, except that this boat 402 further includes a thermostat 504 that is coupled to the CCU 114 (and, directly or indirectly) to the water pump 112. With the example variant, the controller 136 is also communicatively coupled (wired or wirelessly) to the thermostat 504. As a result, when the controller 136 needs to have the CCU 114 and water pump 112 turn off or on, it can do so by, for example, in some variants, sending a signal to the thermostat 504 that will turn off the thermostat 504, or, in other variants, for example, by sending a signal to the thermostat 504 that will change the temperature setting for the thermostat such that the CCU 114 and water pump 112 will turn off. By way of specific example for purposes of understanding, if the CCU 114 is an air conditioner that is set to maintain a temperature of 70° F. (21° C.) when the ambient temperature is 86° F. (30° C.), the controller 136 might send a signal to the thermostat 504 to change the temperature setting on the thermostat 504 up to 100° F. (38° C.), which would have the effect of causing the CCU 114 and water pump 112 to shut off. When the CCU 114 and water pump 112 are to turn back on again, the thermostat 504 would be reset to 70° F. (21° C.). Conversely, for variants where the CCU 114 is being used as a heat pump, the controller 136 would send a signal to the thermostat 504 to change the temperature setting way down so as to have the effect of causing the CCU 114 and water pump 112 to shut off.

Up to now, the foregoing variants have all been variants that are self contained on the boats. However, that need not necessarily be the case. Rather, variants can be constructed where the controller on the boat has more limited function and control of the shut off of the CCU and water pump can be handled remotely, and, in some variants, for multiple boats concurrently, as will now be explained with reference to FIG. 6.

Figure 6:
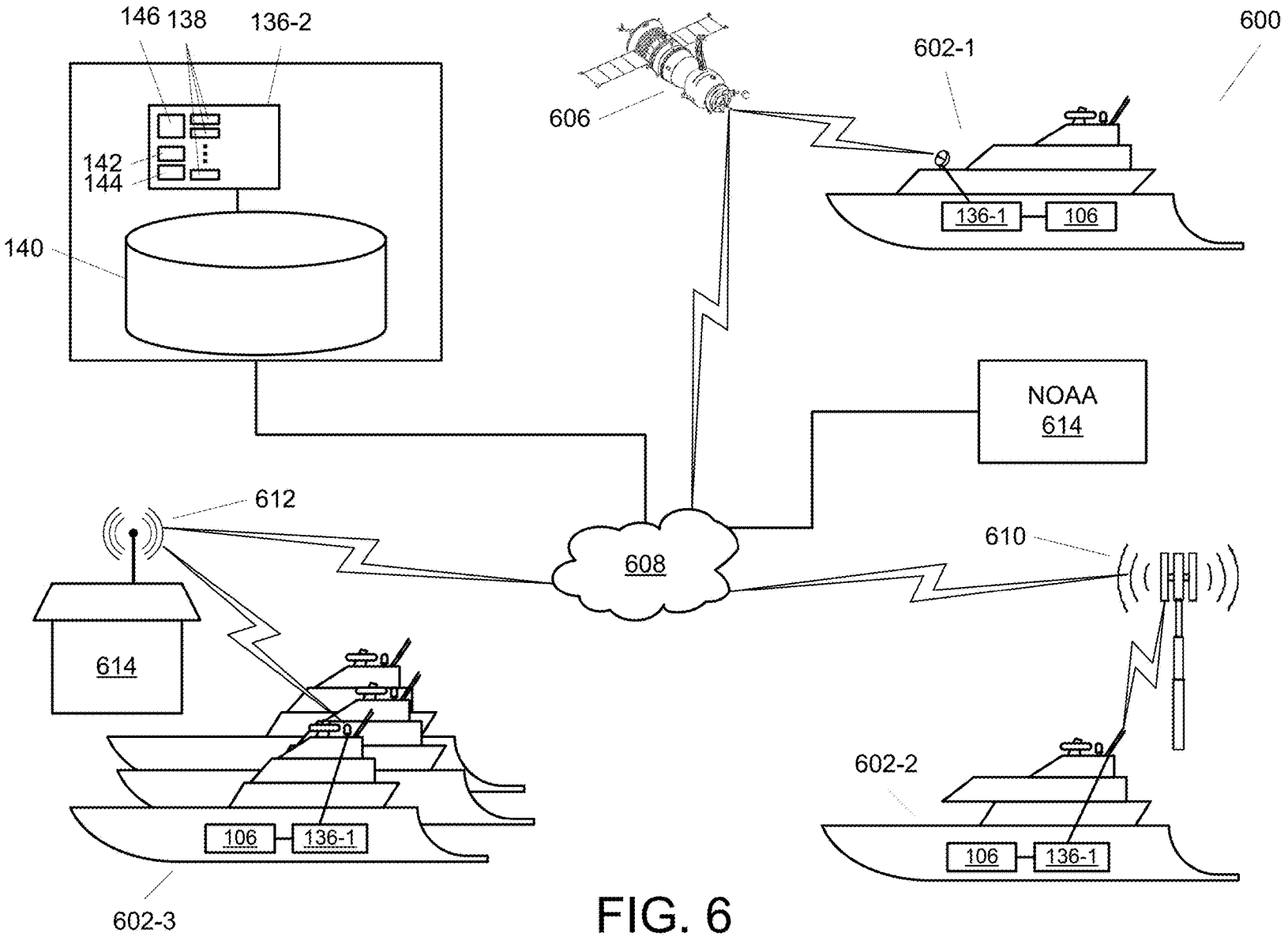
FIG. 6 illustrates, in simplified form, an additional example variant system configured according to the teachings herein.

FIG. 6 illustrates, in simplified form, an additional example variant system 600 configured according to the teachings herein. In accordance with this variant, multiple boats 602-1, 602-2, 603-3 each have systems CC systems 106 as described above and controllers 136-1 coupled to those CC systems 106 that are individually similar to one of those described in connection with FIGS. 1-2 & 4-5, except that the controllers 136-1 on each boat 602-1, 602-2, 602-3 are more limited. Stated another way, the controllers 136-1 have only some of the capabilities described above, with the rest of the capabilities of the controllers 136 described in connection with FIGS. 1-2 & 4-5 being centrally performed at a remote location 604. For example, the controllers 136-1 on the boats 602-1, 602-2, 602-3 are generally only capable of obtaining location information, communicating that information to its remotely located controller 136-2 counterpart, and directly or indirectly causing the CCU 114 and water pump 112 to shut off or turn back on. The remotely located controller 136-2 counterpart handles the aspects obtaining of tide prediction information and determining whether and when to shut off the CCU 114 and water pump 112 of any particular boat 602-1, 602-2, 602-3.

By way of example, with continuing reference to FIG. 6, assume that there are three boats of interest that are equipped with controllers 136-1 as just described. One of the boats 602-1 is anchored off shore at some location (location "L1"), another of the boats 602-2 is docked near the owners home (location "L2") and the third boat 602-3 is berthed in a marina (location "L3") near where the owner has a summer home. Each has subscribed to a remote monitoring service so that they can leave their CC system 106 running even if they are not on their boat. The first boat 602-1 is equipped with a GPS receiver and an IIU that accesses internet 608 websites via satellite 606. The second boat 602-2 connects to internet 608 websites using the cellular 610 communications system. The third boat 602-3 connects to internet 608 websites via a Wifi connection 612 provided by the marina where the boat 602-3 is berthed.

In each case, when the CC system 106 is turned on for the first time, the controller 136-1 on a respective boat 602-1, 602-2, 602-3 the controller 136-1 obtains that boat's location from the respective GPS systems and connects to the controller 136-2 at the remote location 604, typically via the internet 608, and provides that location information to the controller 136-2. The controller 136-2 at the remote monitoring location then stores a unique identifier ("UID") for the particular boat and its associated current location in the storage 140. Then the controller 136-2 accesses a website, for example, the tide prediction website 614 of NOAA and uses that location information to obtain tide predictions for the respective location and stores that information in the storage 140 associated with that specific boat. Then, as described above, the controller 136-2 will determine, using the specific tide prediction data to determine when to have that boat's CC system 106 shut off and turn back on (if at all). Depending upon the particular implementation, the controller 136-2 can then, for example, specifically send a signal to the controller 136-1 on the particular boat when it is time to cause the CCU 114 and water pump 112 of that boat to shut off and later send another signal to the controller 136-1 on the particular boat when it is time to cause the CCU 114 and water pump 112 of that boat to turn back on. Alternatively, for other variants, the controller 136-2 will send a signal to the controller 136-1 on the boat with, effectively, a schedule (for a given time window) of times for the controller 136-1 on the particular boat of times to cause the CCU 114 and water pump 112 of that boat to turn off and then back on within that time window.

In addition, with some implementations, where the controller 136-1 on a boat 602-1, 602-2, 602-3 can identify, for example from the GPS coordinates, that the boat 602-1, 602-2, 602-3 has changed locations by more than a certain distance, the controller 136-1 can be programmed to then connect to its counterpart remotely located controller 136-2 so that the remotely located controller 136-2 can obtain and store updated tide prediction information and, if necessary, provide an updated schedule to the controller 136-1 on the particular boat 602-1, 602-2, 602-3. For implementations where the controller 136-1 on the particular boat 602-1, 602-2, 602-3 lacks that capability, either the controller 136-2 can periodically contact its counterpart controller 136-1 to obtain the then-current location and, if the then-current location has changed, update the information in the storage 140 for that boat 602-1, 602-2, 602-3 and obtain new tide prediction information, and so forth, or the controller 136-1 on the particular boat 602-1, 602-2, 602-3 can simply periodically obtain its location and provide that information to the remote controller 136-2 counterpart and allow the controller 136-2 to determine whether the location has changed and an update is necessary.

Up to now, the foregoing has focused on variants for boats present in tidal waters. However, advantageously, alternative variants can be constructed that do not require use of tide prediction information, making such variants suitable for use in non-tidal waters where seiches are prevalent, as well as in other non-tidal waters where the water level changes over a period of hours or days due to other reasons.

Figure 7:
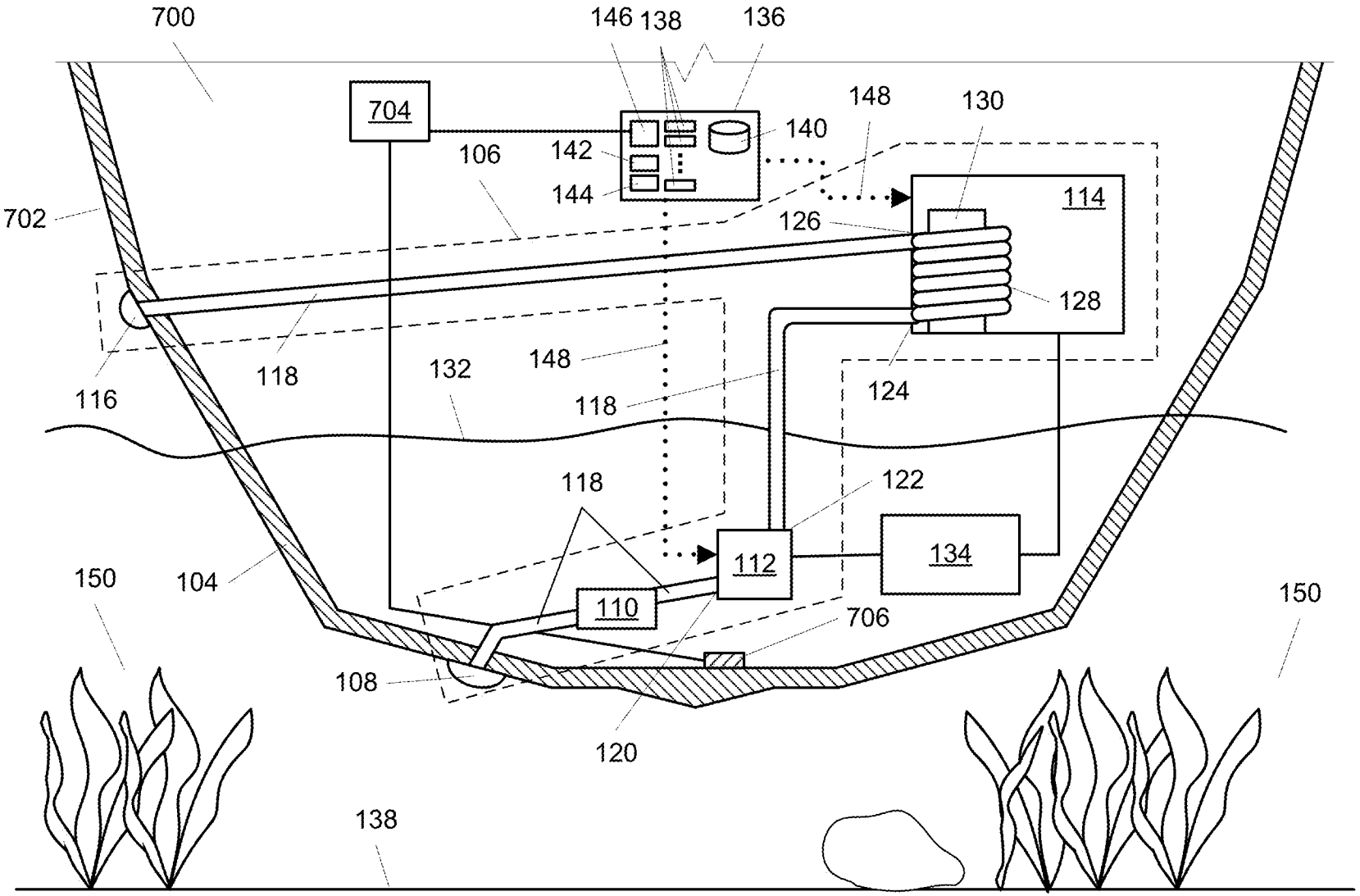
FIG. 7 illustrates, in simplified form, an additional example variant system for a boat that is configured according to the teachings herein and usable in non-tidal waters.

FIG. 7 illustrates, in simplified form, an additional example variant system 700 for a boat 702 that is configured according to the teachings herein and usable in non-tidal waters.

This variant 700 is similar to the previous ones, except the boat 702 of this variant is equipped with a depth finder 704 (e.g., tone burst (a.k.a. single burst), Compressed-high-intensity-pulsed-radar ("CHIRP") a.k.a. swept frequency, or DownScan, DownVu or ClearVu)) including a transducer 706 near the bottom of the boat 702 to detect the depth of water beneath the boat 702 (e.g., the distance between the bed 138 and the transducer 706). In addition, some depth finders 704 ("fish finders") are also capable of detecting sufficiently dense vegetation and other submerged debris, which, as will be explained, can provide further advantages.

With boats 702 employing this variant 700, at intervals when the CC system 106 is turned on, the controller 136 will, at intervals, obtain depth readings from the depth finder 704 and compare those received depth readings to a specified minimum acceptable depth stored in the storage 140, RAM 142 or ROM 144 (depending upon the specifics of the implementation) such that, when a then-current depth is determined to be less than the specified minimum acceptable depth, the controller 136 will, directly or indirectly, cause the CCU 114 and water pump 112 to shut off in a manner previously described above.

Once this happens, the controller 136 will then continue to obtain depth readings and, when, at a subsequent time, the then-current depth is determined to then be greater than the specified minimum acceptable depth, the controller 136 will, directly or indirectly, cause the CCU 114 and water pump 112 to turn back on.

Now, it is to be understood for variants employing a depth finder in this manner, in many cases, a single reading could provide a false indication of too low a depth due to, for example, an unusually low trough of a wave. As such, controllers 136 in most implementation variants of this type will be programmed to obtain multiple readings from the depth finder 704 within some specified window of time and then, depending upon the implementation, the controller 136 will determine whether or not to cause a shut off of the CCU 114 and water pump 112 based on, for example, the presence of at least a certain number of readings below the minimum acceptable depth, or, the controller 136 can calculate one of a mean, median or mode for the readings, and then compare that calculated value to the minimum acceptable depth to make the determination.

The same can be applied following shut off of the CCU 114 and water pump 112 to determine whether to cause the CCU 114 and water pump 112 to turn back on, i.e., the controller 136 can, at intervals, receive depth readings from the depth finder 704 and base a determination of whether to cause the CCU 114 and water pump 112 to turn back on upon multiple readings within a specific window of time. Alternatively, the controller 136 can, for example, be programmed to, following the causing of a shut off, automatically wait for some pre-set period of time before re-checking to determine whether the then-current depth is consistently above the minimum acceptable depth, or it can simply wait a pre-set period of time and then simply cause the CCU 114 and water pump 112 to turn back on.

Still further, advantageously, if the boat 702 is equipped with a fish finder type depth finder 704, that device and be used to detect potential foul-causing debris above the bed 138. Depending upon the particular implementation and data that the depth finder 704 can provide, the controller 136 can use the raw data to identify when the depth between the bottom of the boat 702 and some debris above the bed 136 is too small. Alternatively, if the controller 136 can receive the depth finder 704 image and perform image processing on that data to, for example, differentiate transient fish or hard rocks from underwater vegetation or other submerged potentially system-fouling debris and, using the depth between the boat 702 and bed 138 as scale, determine the depth to the vegetation or debris and treat that depth as the depth to the bed, thereby causing a shut down based upon the vegetation height.

Depending upon the particular implementation, some or all of the depth threshold, window of time, off time, time to turn on, number of readings to use, etc., can be pre-programmed or can be specified by the user, either at installation, or "on the fly" as desired.

Of course, depending upon the particular implementation, the operation of the controller 136 for non-tidal waters, in terms of how it causes the shut down (i.e., cutting off power, directly or indirectly to the CCU 114 and pump 112, or changing a thermostat) would be the same as described above. Accordingly, those aspects need not be repeated.

It should now also be appreciated that these non-tidal water variants can also, advantageously, be readily be used in tidal waters.

Still further, having described various aspects through different example potential implementation variants, it should now be apparent that still further variants could be created that combine the variants for non-tidal waters with those for use in tidal waters. Advantageously, by doing so certain additional advantages can be achieved. For example, tide prediction information generally covers a large area and, therefore, toes not take into account hyper local geographical or other underwater features. Thus, for example, while a tide prediction table obtained using GPS coordinates for a boat's location may indicate a low tide of 1 ft (30.5 cm) and the current tide height is 4.5 ft (137.5 cm) at that location, the boat might specifically be located over a sand bar that is 1 ft (30.5 cm) higher than the surrounding sea bed or, conversely, the boat might be located over a significant depression/gully/localized drop off that provides about an extra 3 ft (91 cm) of depth. As a result based upon the above approaches, in the former case, a controller as described for the tidal variants above, could cause a shut off way too late and, in the latter case, might cause a shut off when none is required. Through use of variants that combine both systems and approaches, such hyper local differences can be accounted for.

Figure 8:
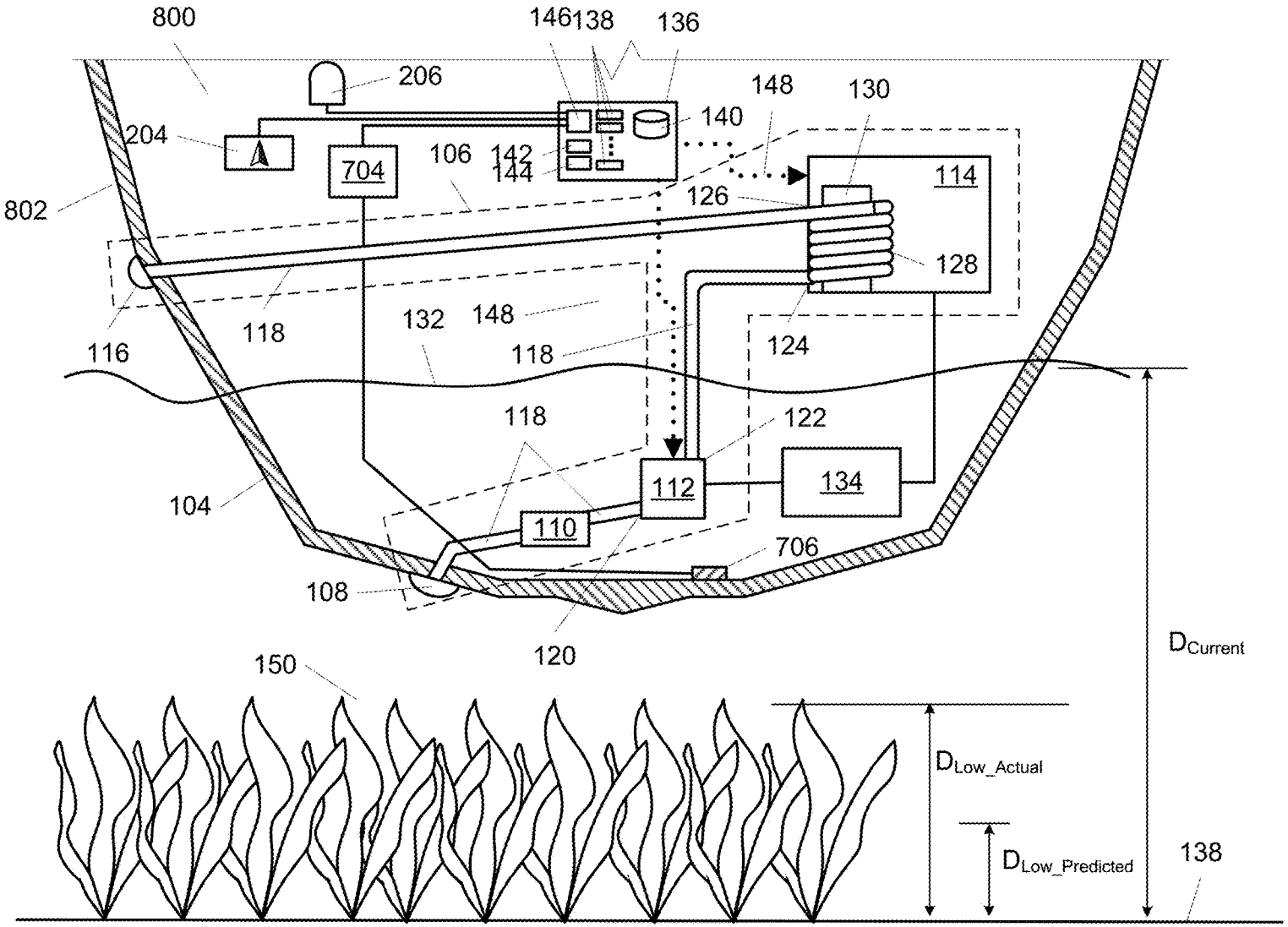
FIG. 8 illustrates, in simplified form, an additional example variant system for a boat that is configured according to the teachings herein to account for hyper local variations in tidal waters.

FIG. 8 illustrates, in simplified form, an additional example variant system 800 for a boat 802 that is configured according to the teachings herein to account for hyper local variations in tidal waters.

As shown in FIG. 8. the boat 802 is anchored above a patch of undersea vegetation 150. Now, in general, according to the implementations of FIGS. 1-2, 4-5, using the tide prediction information as described above, a controller 136 would determine that the current depth is $D_{Current}$ and that the depth at low tide would be $D_{Low_Predicted}$. However, because the boat is anchored over the undersea vegetation 150, the boat 802 will encounter that vegetation 150 when the depth gets to $D_{Low_Actual}$, which may occur be well before low tide and will last until, potentially, well after low tide as predicted. Advantageously, different operational variants can be created where such system 800 components are present.

One such example operational variant would initially use an approach described above for one of tidal waters type systems to use the GPS location information to obtain the tide prediction information. At about the same time, the depth finder 704 would be used to determine the current depth at the specific location of the boat 800. Based upon the then-current time, the controller 136 would then determine the supposed current predicted depth and compare that with the current depth obtained using the depth finder. and, based upon the depth finder reading, generate an offset for the tide prediction from which the controller would determine when (or if) effecting shut of the CCU 114 and water pump 112 should occur.

Another example operational variant, would use the tide prediction information to determine the current depth at the specific location of the boat 800 and when (or if) effecting shut of the CCU 114 and water pump 112 should occur and, at about the time that a shut off should occur, the controller could obtain the actual depth information and use that to override a shut off if the then-current depth was not at or below the threshold at that point. Further variants of this approach could then use only the depth finder information to monitor the depth and effect a shut off when the threshold is met or passed. Likewise, still further variants could take the approach further and solely rely upon the depth finder 704 readings to determine when to cause the CCU 114 and water pump 112 to turn back on, in this regard, ignoring the tide predictions entirely. Of course, it is to be understood that still other variants could make use of other permutations and combinations of the configuration approaches without departing from the teachings herein, which in the interests of brevity will not be discussed but should be considered to be within the scope of the description herein.

Finally, it is to be understood that system variants involving a depth finder 704 can also be used for more transient situations, for example, when a boat is underway, the depth finder data could be continually checked by a controller 136 and if, at any time, the low depth threshold is passed some number of times within a specified period of time, the controller can cause the CCU 114 and water pump 112 to shut off for some preset period of time. Of course, to prevent short cycling of the CCU 114, the time window and number of times the low depth threshold is passed could be programmed for, for example, the type of location (e.g., clear Caribbean waters vs. turbid Northeast bays and canals) or to take into account the speed of the boat at the time.

Having described and illustrated the principles of this application by reference to one or more examples, it should be apparent that embodiment(s) may be constructed and/or modified in arrangement and detail without departing from the principles disclosed herein and that it is intended that the application be construed as including all such modifications and variations insofar as they come within the spirit and scope of the subject matter disclosed.

The foregoing outlines, generally, the features and technical advantages of one or more implementations that can be constructed based upon the teachings in this disclosure in order that the following detailed description may be better understood. However, the advantages and features described herein are only a few of the many advantages and features available from representative examples of possible variant implementations and are presented only to assist in understanding. It should be understood that they are not to be considered limitations on the invention as defined by the appended claims, or limitations on equivalents to the claims. For instance, some of the advantages or aspects of different variants are mutually contradictory, in that they cannot be simultaneously present in a single embodiment. Similarly, some features or advantages may be applicable to one aspect and inapplicable to others. Thus, the foregoing features and advantages should not be considered dispositive in determining equivalence. Additional features and advantages will be apparent from the teachings of the description, drawings, and claims.

What is claimed is:

1. A control apparatus for a Climate Control (CC) system of a boat, wherein the CC system includes a water-fed Climate Control Unit (CCU) and a water pump which feeds water to the CCU, the control apparatus comprising:

i) at least one processor;

ii) non-transitory storage accessible by the processor; and iii) programming which, when executed by the at least one processor will cause the at least one processor to, when the water-fed CCU is operating A) determine a then-current depth at a current location of the boat, B) compare the then-current depth at the current location of the boat relative to a specified minimum acceptable depth, and C) when the then-current depth at the current location of the boat is less than the specified minimum acceptable depth, cause the CCU and water pump to shut off.

2. The control apparatus of claim 1, wherein the at least one processor will determine the then-current depth at the current location of the boat, by obtaining depth readings from a depth finder of the boat.

3. The control apparatus of claim 1, wherein the at least one processor will determine the then-current depth at the current location of the boat, by obtaining a set of current GPS coordinates for the current location via a GPS receiver, using the set of GPS coordinates, to obtain tide predictions for the current location, and identify the then-current depth based upon the tide predictions and a current time of day.

4. The control apparatus of claim 3, wherein the at least one processor will obtain the tide predictions for the current location from an internet-accessible source via an Internet Interface Unit (IIU) on the boat.

5. The control apparatus of claim 1, wherein the boat includes a thermostat, communicatively coupled to the at least one processor, and wherein the at least one processor will cause the CCU and water pump to turn off by sending a signal to the thermostat.

6. The control apparatus of claim 5, wherein the signal will shut off the thermostat.

7. The control apparatus of claim 5, wherein the signal will change a temperature setting of the thermostat to a temperature that will cause the CCU and water pump to turn off.

8. The control apparatus of claim 1, wherein the at least one processor will cause the CCU and water pump to turn off by causing a disruption of power to the CCU and water pump.

9. A control apparatus for a Climate Control (CC) system of a boat having a hull comprising:

a Climate Control Unit (CCU) having a condenser including an inlet and outlet;

a water pump having an inlet and an outlet, wherein the outlet of the water pump is coupled to the inlet of the condenser;

a water inlet, located on the hull below a waterline and coupled to an inlet side of the water pump;

a water outlet located on the hull above the waterline and coupled to the outlet of the condenser unit;

a GPS receiver;

an Internet Interface Unit (IIU); and a controller, coupled to the CCU, GPS receiver and IIU, the controller comprising i) at least one processor, and ii) non-transitory storage accessible by the processor;

wherein, during operation of the CCU, water will flow into the water inlet, through the water pump, through the condenser and out the water outlet; and wherein the at least one processor of the controller, operating under program control when the CCU is operating, will A) obtain a set of current GPS coordinates for the boat location via the GPS receiver, B) using the set of GPS coordinates, obtain tide depth predictions for the location via the IIU, and C) based upon a current time of day, determine a current depth at the location, and in accordance with a pre-specified depth threshold, the controller will cause the CCU and water pump to shut off.

10. The control apparatus of claim 9, wherein controller is programmed to continue to repeat "C)" until, a subsequent indication that the then-current depth will exceed the pre-specified depth threshold, at which point the controller will automatically cause the CCU and water pump to turn back on.

11. The control apparatus of claim 9, further comprising:

a thermostat, communicatively coupled to the at least one processor, and wherein the at least one processor will cause the CCU and water pump to turn off by sending a signal to the thermostat.

12. The control apparatus of claim 11, wherein the signal will shut off the thermostat.

13. The control apparatus of claim 11, wherein the signal will change a temperature setting of the thermostat to a temperature that will cause the CCU and water pump to turn off.

14. The control apparatus of claim 9, wherein the at least one processor will cause the CCU and water pump to turn off by causing a disruption of power to the CCU and water pump.

15. A control apparatus for a Climate Control (CC) system of a boat having a hull comprising:

a Climate Control Unit (CCU) having a condenser including an inlet and outlet;

a water pump having an inlet and an outlet, wherein the outlet of the water pump is coupled to the inlet of the condenser unit;

a water inlet, located on the hull below a waterline and coupled to an inlet side of the water pump;

a water outlet located on the hull above the waterline and coupled to the outlet of the condenser unit;

a depth finder;

a controller, coupled to the air conditioning unit, the controller comprising i) at least one processor, and ii) non-transitory storage accessible by the processor;

wherein, during operation of the CCU, water will flow into the water inlet, through the water pump, through the condenser unit and out the water outlet; and wherein, when the CCU is operating, the controller will obtain depth readings from the depth finder and, when a then-current depth reading is less than a pre-specified minimum depth threshold, the controller will cause the CCU and water pump to shut off.

16. The control apparatus of claim 15, wherein, following shut off of the CCU and water pump, the controller will continue to obtain depth readings and will turn the CCU and water pump back on when at least a pre-specified number of depth readings indicates a new depth that is above the pre-specified minimum depth threshold.

17. The control apparatus of claim 15, wherein the system further includes a thermostat, communicatively coupled to the at least one processor, and wherein the at least one processor will cause the CCU and water pump to turn off by sending a signal to the thermostat.

18. The control apparatus of claim 17, wherein the signal will shut off the thermostat.

19. The control apparatus of claim 17, wherein the signal will change a temperature setting of the thermostat to a temperature that will cause the CCU and water pump to turn off.

20. The control apparatus of claim 15, wherein the at least one processor will cause the CCU and water pump to turn off by causing a disruption of power to the CCU and water pump.

21. A method performed by a controller to control a Climate Control (CC) system of a boat, wherein the CC system includes a water-fed Climate Control Unit (CCU) and a water pump which feeds water to the CCU, the method comprising:

A) when the water-fed CCU and water pump are operating, i) determining a then-current depth at a current location of the boat, ii) comparing the then-current depth at the current location of the boat to a pre-specified minimum acceptable depth, and iii) when the then-current depth at the current location of the boat is less than the pre-specified minimum acceptable depth, causing the water-fed CCU and water pump to shut off.

22. The method of claim 21, wherein subsequent to "A)iii)", the method comprises:

continuing determining depths at the current location of the boat until at least one subsequent depth is above the pre-specified minimum acceptable depth.

23. The method of claim 22, wherein, when the at least one subsequent depth is above the pre-specified minimum acceptable depth, causing the water-fed CCU and water pump to turn back on.

24. The method of claim 22, wherein CC system further includes a thermostat, and wherein the causing the water-fed CCU and water pump to shut off includes:

sending a signal to the thermostat.

25. The method of claim 24, wherein the signal is a signal that will shut off the thermostat.

26. The method of claim 22, wherein the signal is a signal that will change a temperature setting of the thermostat to a temperature that will cause the CCU and water pump to turn off.

27. The method of claim 21, wherein the causing the CCU and water pump to turn off includes:

causing a disruption of power to the CCU and water pump.

28. The method of claim 21, wherein step "A)i)" comprises:

receiving GPS coordinates from a GPS receiver on the boat;

using the received GPS coordinates, obtaining tide depth predictions for the location via an Internet Interface Unit, and based upon a current time of day, determining the then-current depth at the current location.

29. The method of claim 28, wherein the obtaining the tide depth predictions for the location includes:

obtaining tide prediction information via an internet interface unit on the boat.

30. The method of claim 21, wherein step "A)i)" comprises:

receiving a depth indication from a depth finder of the boat.

* * * * *